US005680731A

United States Patent [19]

Guy

[11] Patent Number: 5,680,731

[45] Date of Patent: Oct. 28, 1997

[54] METHOD AND APPARATUS FOR LEVELING A PORTABLE BUILDING

[75] Inventor: Norman B. Guy, Topeka, Kans.

[73] Assignee: PTMW, Incorporated, Meriden, Kans.

[21] Appl. No.: 597,143

[22] Filed: Feb. 6, 1996

[51] Int. Cl.[6] ..... F16M 13/00

[52] U.S. Cl. ..... 52/126.1; 52/126.4; 52/126.7; 52/169.9; 248/188.2; 248/188.4; 248/354.3; 254/89 R

[58] Field of Search ..... 52/126.4, 126.7, 52/169.4, 169.9, 169.12, 299, DIG. 11, 126.1; 248/188.2, 188.4, 188.5, 354.3, 354.4, 354.5, 407, 423; 254/89 R, 100, 101, DIG. 1

[56] References Cited

U.S. PATENT DOCUMENTS

| | | | |
|---|---|---|---|
| 4,352,479 | 10/1982 | Chapman, Jr. | 248/188.4 X |
| 4,404,780 | 9/1983 | Josephson | 52/126.7 |
| 4,417,426 | 11/1983 | Meng | 52/126.7 |
| 4,684,097 | 8/1987 | Cox | 248/354.3 |
| 4,876,834 | 10/1989 | Domigan | 248/188.4 X |
| 4,895,335 | 1/1990 | Oliver | 52/126.7 X |
| 4,899,497 | 2/1990 | Madl, Jr. | 52/169.9 X |
| 5,499,482 | 3/1996 | Goff | 52/169.9 X |

FOREIGN PATENT DOCUMENTS

| | | | |
|---|---|---|---|
| 597687 | 2/1948 | United Kingdom | 52/126.7 |

*Primary Examiner*—Carl D. Friedman
*Assistant Examiner*—Kevin D. Wilkens
*Attorney, Agent, or Firm*—Shook, Hardy & Bacon L.L.P.

[57] ABSTRACT

An apparatus for accommodating level placement of a portable building on a support surface includes a foundation leg movable relative to the building and adjustable from inside the building. The length of the foundation leg which extends below the building to the support surface is determined by selectively engaging a bracket in slots in the foundation leg. An adjusting plate is coupled to the bracket and a threaded member is coupled with the adjusting plate. When the bracket engages a slot, the threaded member may be manually adjusted to raise and lower the foundation leg. A portable building adapted for level placement on a support surface may include a plurality of foundation legs and a corresponding number of locking devices for raising and lowering the foundation legs relative to the floor of the building. Each locking device includes a bracket, an adjusting plate and a manually operable member coupled with the adjusting plate. The building may be set or adjusted by moving one of the foundation legs in relatively large increments to a position which approximates a level condition for the building. Further movement in relatively large increments is prevented by securing the bracket in the slots of the foundation leg. Then, the leg may be moved in relatively small increments to obtain a level condition for the building by adjusting the manually operable member to either raise or lower the foundation leg by the desired amount.

34 Claims, 2 Drawing Sheets

Fig.1.
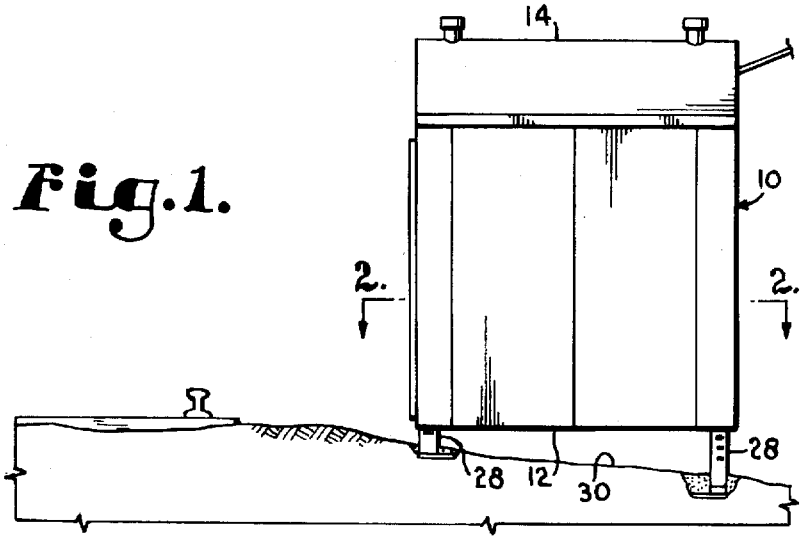
Fig.2.
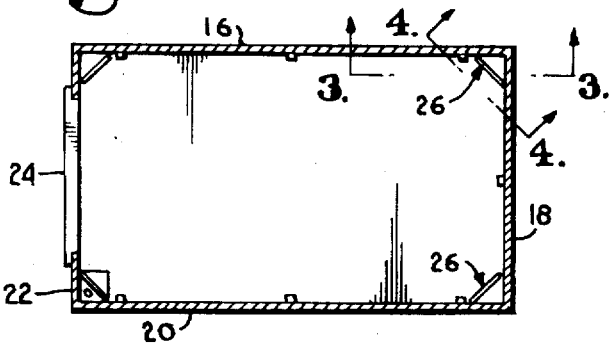
Fig.4.
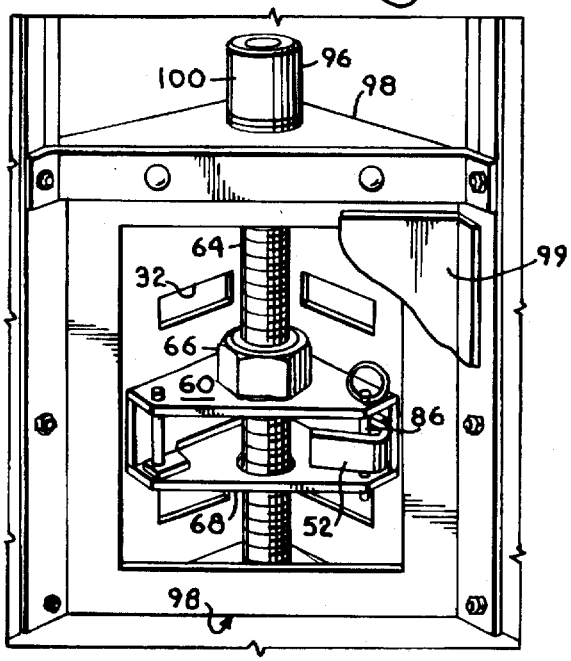
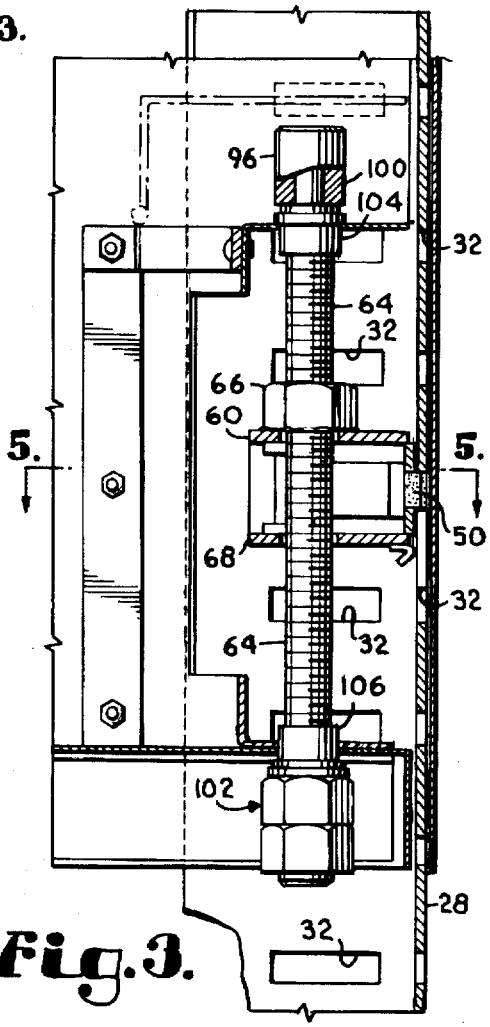
Fig.3.

Fig. 5.
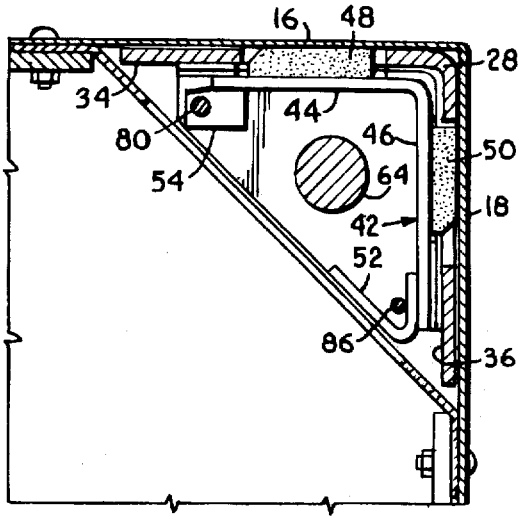
Fig. 6.
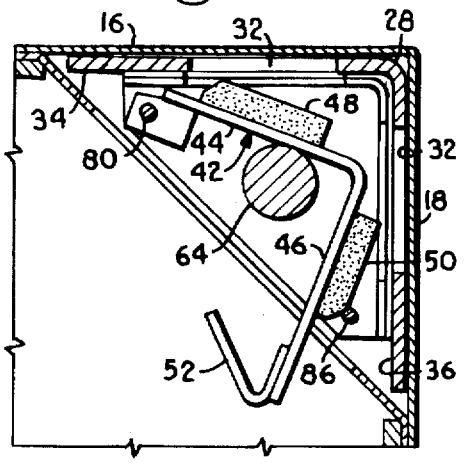
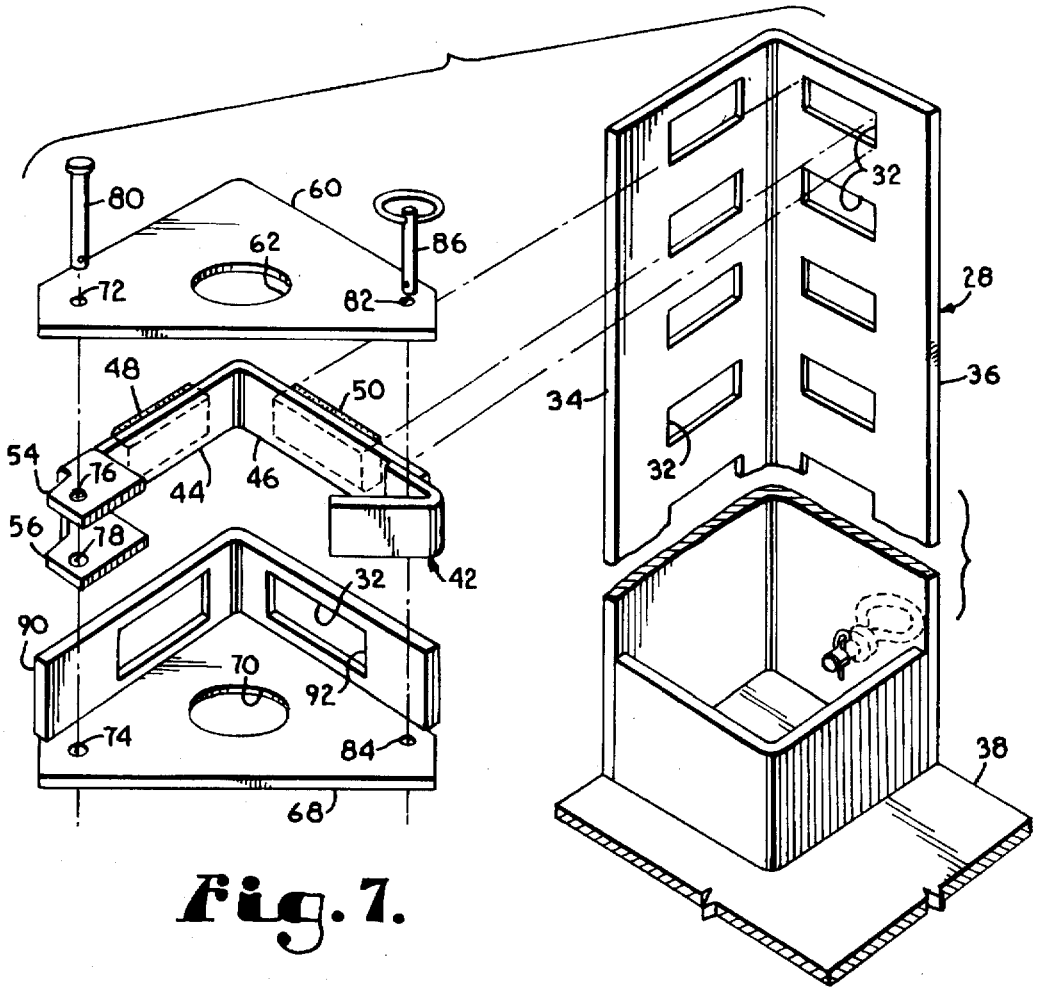
Fig. 7.

METHOD AND APPARATUS FOR LEVELING A PORTABLE BUILDING

BACKGROUND OF THE INVENTION

This invention relates in general to a method and apparatus for accommodating level placement of a building on a support surface and, more particularly, to a method and apparatus for selectively moving a foundation leg from within a portable building to level the building.

Portable buildings have been used for many years in a variety of settings. For example, such buildings have long been placed along railroad right-of-ways to house control equipment. These buildings are located above a support surface, such as the ground, which is typically not level. Thus, it is important to provide a portable building that can be placed upon a variety of different support surfaces having different slopes or grades.

Since portable buildings may be subjected to extreme weather conditions and other environmental factors such as the vibrations from passing trains, it is also important to provide a portable building that may be adequately secured onto its support surface. Moreover, it is desirable to position these buildings so that their floors are level, even though the surface below the building is usually not level. Over time, the weather and other external forces will eventually cause the building to lean one direction or another. Thus, it is also necessary to provide a portable building that may be conveniently readjusted long after the building is first set.

Previous attempts to provide a portable building having the attributes set forth above have met with only limited success. A common approach is to support the building with four large posts which extend through the floor. Initially, the building is set on a berm, and the foundation is dropped into holes that are dug for the posts. Each post has several spaced openings near its base so that the length of the post that extends below the floor can be selectively adjusted by raising the side of the building and placing a locking pin through one of the holes in the post below the floor. Next, the building is lowered until it comes to rest at the position determined by the locking pin, and the foundation may be secured in place by backfilling dirt over the base of the posts. To later adjust the length of post that extends below the floor, a side of the building must first be raised. Then, a worker must reach or crawl below the raised building and move the locking pin to a different opening.

This prior art approach of providing adjustable posts for a portable building has several distinct disadvantages. First, it is cumbersome to adjust the length of the posts because one side of the building must be jacked up above its normal position before the worker can gain access to the locking pin. Second, leveling the building may require multiple adjustments because the posts are adjusted when the building is in a raised position, so the effect of an adjustment is not immediately apparent. Third, requiring a worker to reach or crawl underneath a raised building to move the locking pin from one position to another raises serious safety concerns, especially during adverse weather conditions. Fourth, the posts take up considerable space inside the building and render the adjacent wall space unusable. Therefore, less space is available for storing control equipment, and the space available for workers to move about within the building is substantially reduced.

SUMMARY OF THE INVENTION

The present invention is directed to an improved method and apparatus for accommodating level placement of a portable building on a support surface. The invention overcomes the problems and limitations set forth above by providing a leveling apparatus adapted to be disposed in the corner of a portable building. The leveling apparatus includes a foundation leg which extends below the floor of the building, but which takes up considerably less space within the building than conventional posts. Furthermore, the length of the foundation leg which extends below the building may be adjusted from inside the building by manipulating the leveling apparatus with a common tool. Thus, the area within the building may be more efficiently used for housing control equipment and more work space is provided. Additionally, the invention provides a much safer alternative for workers because the foundation legs may be dropped or adjusted from inside the building without raising the side of the building. Therefore, workers are not subjected to the safety risks associated with adjusting the posts from underneath the building. Moreover, the invention provides a more precise and less time consuming method and apparatus for leveling a portable building because a worker can determine whether the building is level at the same time the foundation legs are being adjusted.

Accordingly, it is an object of the present invention to provide a method and apparatus for accommodating level placement of a building on a support surface which does not require a worker to go underneath the building.

It is a further object of the present invention to provide an apparatus for accommodating level placement of a building on a support surface which has an angular configuration corresponding to a corner of the building so that usable space within the building is maximized.

It is another object of the present invention to provide a method and apparatus for accommodating level placement of a building on a support surface wherein the position of a foundation leg may be adjusted without raising the building.

It is yet another object of the present invention to provide a method and apparatus for accommodating level placement of a building on a support surface so that a foundation leg may be extended below the floor of the building and locked in position from inside the building.

Another object of the present invention is to provide a method and apparatus for accommodating level placement of a building on a support surface so that the position of a foundation leg with respect to the floor of the building may be raised or lowered from inside the building.

Yet another object of the present invention is to provide a method and apparatus for accommodating level placement of a building on a support surface wherein a bracket is adapted to engage the slots in a foundation leg for securing the building in a position which approximates a level condition. A related object of the present invention is to provide a method and apparatus for accommodating level placement of a building on a support surface wherein a foundation leg may be raised or lowered in relatively small increments by a tool adapted to engage the leveling apparatus from inside the building.

A further object of the present invention is to provide a portable building adapted for level placement on a support surface having at least two foundation legs with corresponding locking devices so that the legs may be dropped and adjusted from inside the building.

Still another object of the present invention is to provide a portable building adapted for level placement on a support surface and including a plurality of foundation legs and locking devices having an angular configuration corresponding to the corners of the building so that usable space within the building is maximized.

These and other related objects of the preset invention will become readily apparent upon further review of the specification and drawings. To accomplish the objects of the present invention, a building leveling apparatus is provided comprising a foundation leg presenting a plurality of slots and being movable relative to the building, a bracket coupled with the building and adapted for selectively engaging the slots in the foundation leg, an adjusting plate coupled to the bracket and a manually operable member coupled with the adjusting plate and operable for raising and lowering the foundation leg when the bracket engages a slot.

Moreover, a portable building in accordance with the objects of the present invention is provided comprising a floor support, a plurality of walls coupled to the floor support and arranged adjacent to one another along the perimeter of the floor support, a plurality of foundation legs each presenting a plurality of vertically spaced slots and each being movable relative to the floor support and at least two locking devices, wherein each locking device comprises a bracket for selectively engaging the slots in a foundation leg, an adjusting plate coupled to the bracket and a manually operable member coupled with the adjusting plate and operable to raise and lower the foundation leg when the bracket engages a slot.

In another aspect, the objects and advantages of the present invention may be achieved by a method for level placement of a building relative to a support surface comprising the steps of providing an adjustable leg support for the building, moving the leg in relatively large increments to a position which approximates a level condition for the building, preventing further movement in relatively large increments by securing the leg in the position in which it approximates a level condition for the building and further moving the leg in relatively small increments to finally adjust the leg height to support the building in a level position.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a side elevational view of a portable building in accordance with a preferred embodiment of the present invention and situated along a railroad right-of-way;

FIG. 2 is a sectional view of a portable building of the present invention taken along line 2—2 of FIG. 1;

FIG. 3 is a sectional view of a leveling apparatus in accordance with the preferred embodiment of the present invention taken along line 3—3 of FIG. 2;

FIG. 4 is a perspective sectional view taken along line 4—4 of FIG. 2;

FIG. 5 is a sectional view taken along line 5—5 of FIG. 3 with the bracket engaging the slots of the foundation leg;

FIG. 6 is similar to FIG. 5 except that the bracket is disengaged from the slots of the foundation leg; and FIG. 7 is an exploded, perspective view of a leveling apparatus in accordance with a preferred embodiment of the present invention.

DESCRIPTION OF THE PREFERRED EMBODIMENT(S)

Referring to the drawings in greater detail, and initially to FIGS. 1 and 2, the portable building of the present invention is designated generally by reference numeral 10. The building 10 is comprised of a floor 12, a roof 14, a plurality of walls 16–22, a door 24, and at least one leveling apparatus 26 having a foundation leg 28. As shown in FIG. 1, legs 28 protrude from the bottom of building 10 toward a support surface 30.

With reference to FIG. 7, leg 28 presents a plurality of slots 32, which are spaced apart vertically. In a preferred embodiment, leg 28 has an angular configuration corresponding to the angle of a corner of the building. Typically, this angle is approximately ninety degrees, so the leg 28 presents planar surfaces 34 and 36 at right angles to one another. In the embodiment shown in FIG. 7, each slot 32 in surface 34 corresponds to a slot 32 in surface 36 so that the slots 32 are arranged in horizontally aligned pairs that are vertically spaced from one another. Leg 28 may also present a base 38 for firmly supporting building 10.

As can be seen in FIGS. 5 and 6, leg 28 is disposed in a corner of the building 10 so that surface 34 is adjacent to the inside of wall 16 and surface 36 is adjacent to the inside of wall 18. Slots 32 can be seen in FIG. 6.

A bracket 42 is shown in FIGS. 5–7. Bracket 42 is adapted for selectively engaging slots 32 of leg 28. In a preferred embodiment, bracket 42 has an angular configuration corresponding to the corner of the building. Thus, bracket 42 presents planar surfaces 44 and 46 which meet at a right angle. Additionally, bracket 42 presents lugs 48 and 50 disposed along planar surfaces 44 and 46, respectively, to correspond with the slots 32 of leg 28. Bracket 42 further includes a tab 52 disposed at the outer end of surface 46. As will be explained further below, bracket 42 also includes flanges 54 and 56 for coupling the bracket 42 with building 10.

Leveling apparatus 26 also includes an adjusting plate 60. Plate 60, which is coupled to bracket 42, presents an opening 62 through which manually operable threaded post member 64 (FIGS. 3 and 4) passes. As shown in FIG. 4, a nut 66 is tack welded or otherwise affixed to plate 60 for moving the plate vertically in response to the rotational movement of member 64, which in turn will raise or lower leg 28 with respect to the floor 12 of building 10. A bottom plate 68 coupled with plate 60 also moves in response to movement of member 64. Bottom plate 68 presents a relatively large opening 70 corresponding to and aligned with opening 62 in plate 60. Plates 60 and 68 also present openings 72 and 74, respectively, corresponding to openings 76 and 78 on flanges 54 and 56, respectively, to accommodate a pivot pin 80. Pin 80 allows bracket 42 to pivot between being engaged with the slots 32 of leg 28 and being disengaged therefrom. Plates 60 and 68 also present openings 82 and 84, respectively, for accommodating a locking pin 86 that secures bracket 42 in an engaged position. Further, a support plate 90 is provided to couple plate 60 with plate 68 and to support movement of leg 28 in response to movement of member 64. Preferably, plate 90 presents a pair of slots 92 which are arranged to correspond with the slots 32 of leg 28 and to accommodate lugs 48 and 50 of bracket 42.

Referring to FIGS. 3 and 4, threaded member 64 presents a tool receiving socket 96 which is adapted for receiving a conventional tool such as a ratchet tool. A housing 98 may be provided that substantially encloses apparatus 26 within building 10. Housing 98, which includes a cover plate 99, will prevent foreign articles from interfering with the operation of apparatus 26 and will help to seal off the inside of building 10 from the outside.

In the embodiment shown in FIG. 3, a top retention nut 100 rests on an upper portion of housing 98 to prevent downward movement of post 64. Nut 100 is tack welded or otherwise affixed to the top of post 64, and socket 96 is tack welded or otherwise affixed to nut 100. Alternatively, nut 100 may be omitted so that socket 96 prevents downward movement of post 64. In that case, socket 96 is affixed to the top of the threaded post.

To prevent upward movement of post 64, bottom retention nuts 102 are affixed to the bottom of the threaded post. An upper bushing 104 and a lower bushing 106 are disposed along post 64 in proximity to top retention nut 100 and lower retention nuts 102, respectively.

In operation, the building 10 of the present invention may be located on any support surface. If the support surface is not level, leveling apparatus 26 may be employed to level the building. With the bracket 42 disengaged from the slots 32 of the foundation leg 28, leg 28 may be raised or lowered to a desired position. Next, lugs 48 and 50 of bracket 42 engage slots 32 of leg 28 as bracket 42 pivots about pin 80 toward leg 28. Once bracket 42 is engaged with leg 28, locking pin 86 is positioned through openings 82 and 84 to prevent bracket 42 from becoming disengaged from leg 28.

If building 10 is still not level, member 64 may be employed to raise or lower leg 28 in relatively small increments. Tool receiving portion 96 of member 64 may be adjusted in a first direction to raise leg 28 or in a second direction to lower leg 28. Because it is affixed to plate 60, nut 66 will not rotate with member 64. Rather, nut 66 will move vertically as threaded member 64 is rotated since retention nuts 100 and 102 and bushings 104 and 106 cooperate to substantially prevent any vertical movement of member 64. Member 64 and portion 96 are particularly convenient for minor subsequent adjustments to building 10 because bracket 42 need not be disengaged from leg 28. Following the final adjustment, cover plate 99 is positioned over apparatus 26.

If a major adjustment to building 10 becomes necessary at some point in time, it will be necessary to remove cover plate 99 and disengage bracket 42. First, locking pin 86 is removed so it no longer obstructs the path of bracket 42. Then tab 52 is pulled away from leg 28 to disengage lugs 48 and 50 from slots 32. After leg 28 is raised or lowered, bracket 42 is again engaged as described above.

Although the preferred embodiment is a rectangular building having corners at right angles, the present invention contemplates non-rectangular buildings having corners that are not at right angles. Those skilled in the art will readily appreciate the applicability of the present invention to non-rectangular portable buildings.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. An apparatus for accommodating level placement of a building on a support surface, said apparatus comprising:

a foundation leg presenting a plurality of vertically spaced slots and adapted to be movable relative to the building;

a bracket adapted to be coupled with the building, said bracket being adapted for selectively engaging the slots in said foundation leg;

an adjusting plate coupled to said bracket; and a manually operable member coupled with said adjusting plate and operable to raise and lower said foundation leg when said bracket engages a slot, wherein said member is adapted to be accessible from inside the building.

2. The apparatus of claim 1, wherein said bracket has an angular configuration adapted to correspond to an angle of a corner of the building.

3. The apparatus of claim 2, wherein said bracket presents planar surfaces at right angles to one another.

4. The apparatus of claim 1, wherein said bracket presents one or more lugs for engaging the slots in said foundation leg.

5. The apparatus of claim 4, further comprising a locking pin for securing the engagement of said bracket with the slots of said foundation leg.

6. The apparatus of claim 1, wherein said bracket presents a tab for disengaging said bracket from the slots of said foundation leg.

7. The apparatus of claim 1, wherein said foundation leg has an angular configuration adapted to correspond to an angle of a corner of the building.

8. The apparatus of claim 7, wherein said foundation leg presents planar surfaces at right angles to one another.

9. The apparatus of claim 8, wherein each of said planar surfaces has a plurality of said vertically spaced slots, the slots in each surface being in horizontal planar alignment with the slots in the other surface.

10. The apparatus of claim 9, wherein said bracket presents a pair of lugs adapted to engage one slot of each planar surface at the same time.

11. The apparatus of claim 1, wherein said member is threaded.

12. The apparatus of claim 11, wherein said plate is coupled to a nut for receiving said member.

13. The apparatus of claim 11, wherein said member is adapted to receive a tool.

14. The apparatus of claim 13, wherein a portion of said member is adapted to be accessible from inside the building and is adapted to receive the tool.

15. The apparatus of claim 14, wherein said member is adapted for receiving a ratchet tool.

16. A portable building adapted for level placement on a support surface, said building comprising:

a floor support;

a plurality of walls each coupled to said floor support and arranged adjacent to one another along the perimeter of the floor support;

a plurality of foundation legs each presenting a plurality of vertically spaced slots and each being moveable relative to the floor support; and at least two locking devices, wherein each of said locking devices comprises a bracket coupled with at least one of said walls and adapted for selectively engaging the slots in one of said foundation legs, an adjusting plate coupled to said bracket and a manually operable member coupled with said adjusting plate and operable to raise and lower said foundation leg when said bracket engages a slot, wherein said member is accessible from inside the building.

17. The building of claim 16, wherein each of said foundation legs has an angular configuration corresponding to the angle of a corner of the building.

18. The building of claim 17, wherein each of said foundation legs presents planar surfaces at right angles to one another.

19. The building of claim 18, wherein each of said planar surfaces has a plurality of said vertically spaced slots, the slots in each surface being in horizontal planar alignment with the slots in the other surface.

20. The building of claim 19, wherein said bracket presents a pair of lugs adapted to engage one slot of each planar surface at the same time for at least one of said legs.

21. The building of claim 16, wherein said member is threaded.

22. The building of claim 21, wherein said plate is coupled to a nut for receiving said member.

23. The building of claim 21, wherein said member is adapted to receive a tool.

24. The building of claim 23, wherein a portion of said member is accessible from inside the building and is adapted to receive the tool.

25. The building of claim 24, wherein said member is adapted for receiving a ratchet tool.

26. The building of claim 16, wherein said bracket has an angular configuration corresponding to the angle of a corner of the building.

27. The building of claim 26, wherein said bracket presents planar surfaces at right angles to one another.

28. The building of claim 16, wherein said bracket presents one or more lugs for engaging the slots in at least one of said foundation legs.

29. The building of claim 28, wherein each locking device further comprises a locking pin for securing the engagement of said bracket with the slots of said foundation legs.

30. The building of claim 16, wherein said bracket presents a tab for disengaging said bracket from the slots of said foundation legs.

31. A method for level placement of a building relative to a support surface, said method comprising:

providing an adjustable leg support for the building;

moving said leg in relatively large increments to a position which approximates a level condition for the building;

preventing further movement in relatively large increments by securing said leg in the position which approximates a level condition for the building; and further moving said leg in relatively small increments from within the building to finally adjust said leg in a position to support the building in a level position.

32. The method of claim 31, wherein said preventing step further comprises engaging a bracket with slots in said leg.

33. The method of claim 32, further comprising disengaging the bracket from the leg to allow further movement in relatively large increments.

34. The method of claim 31, wherein said further moving step further comprises adjusting a manually operable member to raise or lower said leg in relatively small increments.

* * * * *